US007416490B2

(12) United States Patent
Parsons et al.

(10) Patent No.: US 7,416,490 B2
(45) Date of Patent: Aug. 26, 2008

(54) EXPANDABLE/BATON WITH TWIST RELEASE FOR RETRACTION

(75) Inventors: Kevin L. Parsons, Appleton, WI (US); Lester O. Stener, Blaine, MN (US)

(73) Assignee: Armanent Systems and Procedures, Inc., Appleton, WI (US)

( * ) Notice: Subject to any disclaimer, the term of this patent is extended or adjusted under 35 U.S.C. 154(b) by 173 days.

(21) Appl. No.: 11/593,350

(22) Filed: Nov. 6, 2006

(65) Prior Publication Data

US 2008/0108440 A1 May 8, 2008

(51) Int. Cl.
*F41B 15/02* (2006.01)

(52) U.S. Cl. ..... 463/47.7; 403/366; 285/302

(58) Field of Classification Search ..... 463/47.2, 463/47.7; 280/823; 135/65, 69, 75; 403/109.1, 403/109.2, 109.5, 109.8, 350, 366, 376, 379.6, 403/374, 374.2, 377; 43/18.1; 15/144.4; 285/302; 473/48, 296

See application file for complete search history.

(56) References Cited

U.S. PATENT DOCUMENTS 4,037,839 A * 7/1977 Nelson ..... 463/47.7
5,110,375 A 5/1992 Parsons
5,149,092 A 9/1992 Parsons
5,161,800 A 11/1992 Parsons et al.
5,348,297 A 9/1994 Parsons
5,356,139 A 10/1994 Parsons
5,386,322 A 1/1995 Parsons
5,407,197 A 4/1995 Parsons
5,509,653 A 4/1996 Parsons
5,595,386 A 1/1997 Parsons
5,645,276 A 7/1997 Parsons
5,647,591 A 7/1997 Parsons
5,657,986 A 8/1997 Parsons
5,667,441 A 9/1997 Parsons
5,797,797 A 8/1998 Parsons
5,868,621 A 2/1999 Parsons
5,919,093 A 7/1999 Parsons
5,961,387 A 10/1999 Parsons
H001947 H * 3/2001 Starrett ..... 463/47.7
6,238,292 B1 * 5/2001 Pelkey ..... 463/47.7
6,623,361 B1 9/2003 Parsons

* cited by examiner

*Primary Examiner*—William M Pierce
(74) *Attorney, Agent, or Firm*—Husch Blackwell Sanders Welsh & Katz

(57) ABSTRACT

An expandable baton has a twist release for retraction. Each inner section of the baton can lock in its extended position, relative to the preceding section, after axial extension. That section can be released for axial retraction by rotating that section about the longitudinal axis relative to the preceding section.

45 Claims, 7 Drawing Sheets

EXPANDABLE/BATON WITH TWIST RELEASE FOR RETRACTION

This invention pertains to kinetic impact devices such as batons and nightsticks, and particularly to an expandable baton with a twist release for retraction.

BACKGROUND

For a number of years, expandable batons frequently have been provided to law enforcement officers and to civilian and military security personnel for use as intermediate force weapons. For example, expandable batons manufactured by Armament Systems and Procedures (ASP—the assignee of this application) are very well known among the applicable users and purchasers. The following are some of the patents that relate to existing batons and are incorporated herein by reference: U.S. Pat. Nos. 5,110,375; 5,149,092; 5,161,800; 5,348,297; 5,356,139; 5,386,322; 5,407,197; 5,509,653; 5,595,386; 5,645,276; 5,647,591; 5,657,986; 5,667,441; 5,797,797; 5,868,621; 5,919,093; 5,961,387; and 6,623,361.

In prior art batons, retraction of the inner sections of the baton that are locked in an extended position is typically accomplished by striking the tip of the baton against a hard surface in order to apply a sufficient axial force along the longitudinal axis of the baton. This usually requires the user to bend over, and sometimes requires one or more repeated attempts to accomplish the retraction. Both for ease of use and for minimizing the possibility of damage or wear of the baton, the twist release of the present invention is advantageous for retraction of the inner sections from the extended position in some circumstances and for some users.

BRIEF DESCRIPTION OF THE DRAWINGS

The components in the figures are not necessarily to scale.

DETAILED DESCRIPTION OF SOME EMBODIMENTS

Figure 1:
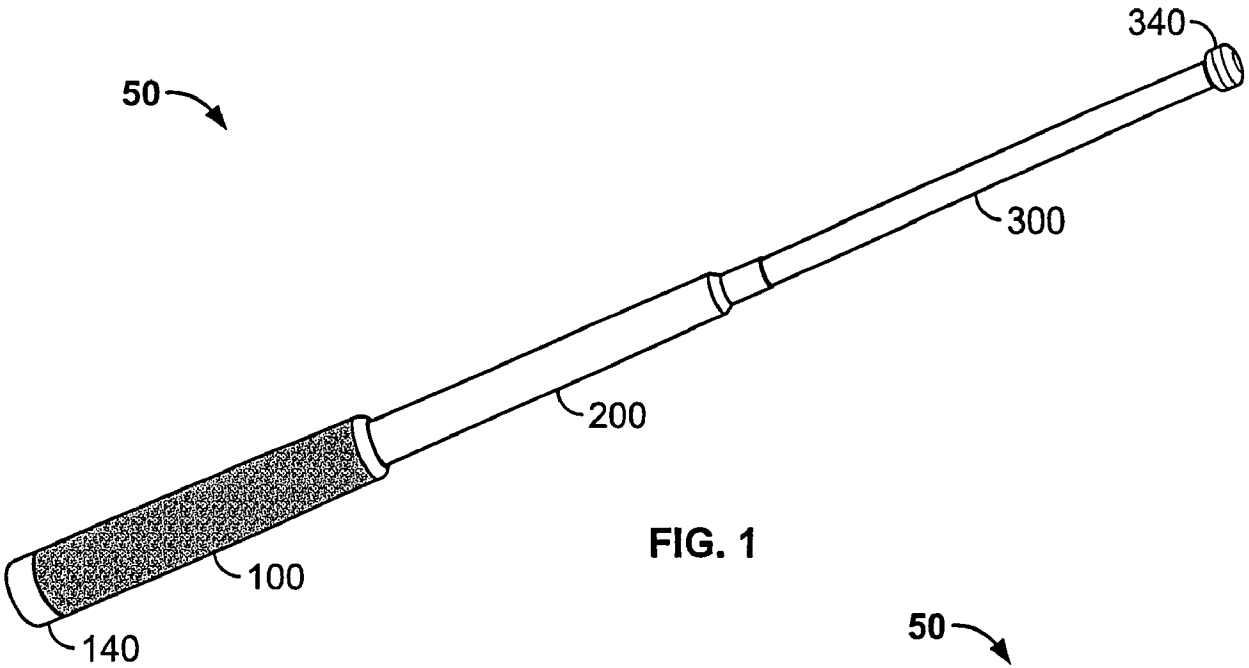
FIG. 1 is a perspective view of one embodiment with each baton section in its extended position.

While the present invention is susceptible of embodiment in various forms, there is shown in the drawings and will hereinafter be described some embodiments with the understanding that the present disclosure is to be considered an exemplification of the invention and is not intended to limit the invention to the specific embodiments illustrated.

Figure 2:
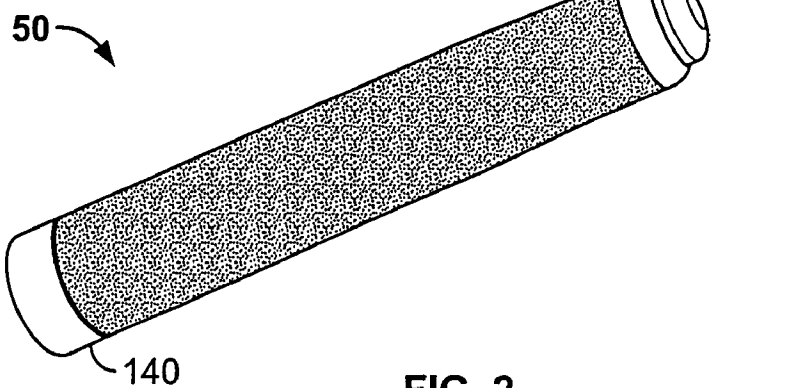
FIG. 2 is a perspective view of that embodiment with the baton sections in their retracted positions.

FIGS. 1 and 2 are perspective views of one embodiment showing the sections of an expandable baton 50 in extended and retracted positions respectively. In the illustrated example, baton 50 comprises a series of three telescoping sections 100, 200 and 300. The innermost section 300 can be received within another inner section 200, that can be received within the outermost section 100. This nesting arrangement allows the sections to move relative to each other along a longitudinal axis between a retracted position and an extended position. In other embodiments, there can be other numbers of sections. The illustrated embodiment is used for purposes of explanation, but one of skill in the art can apply the explanation to other embodiments.

In the retracted position (as shown in FIG. 2), sections 200 and 300 are retained inside section 100. In that position, baton 50 may, for example, be about 8 to 10 inches long and may, for example, be carried in a suitable sheath such as on a user's belt. In the retracted position, baton 50 may, for example, be drawn quickly from a sheath, pocket or other carrying mechanism. It may, for example, be opened in a swinging action for whipping the nested sections out to, and locking them in, the extended position (as shown in FIG. 1).

a. Section 200—Stopping and Locking Members

Figure 3:
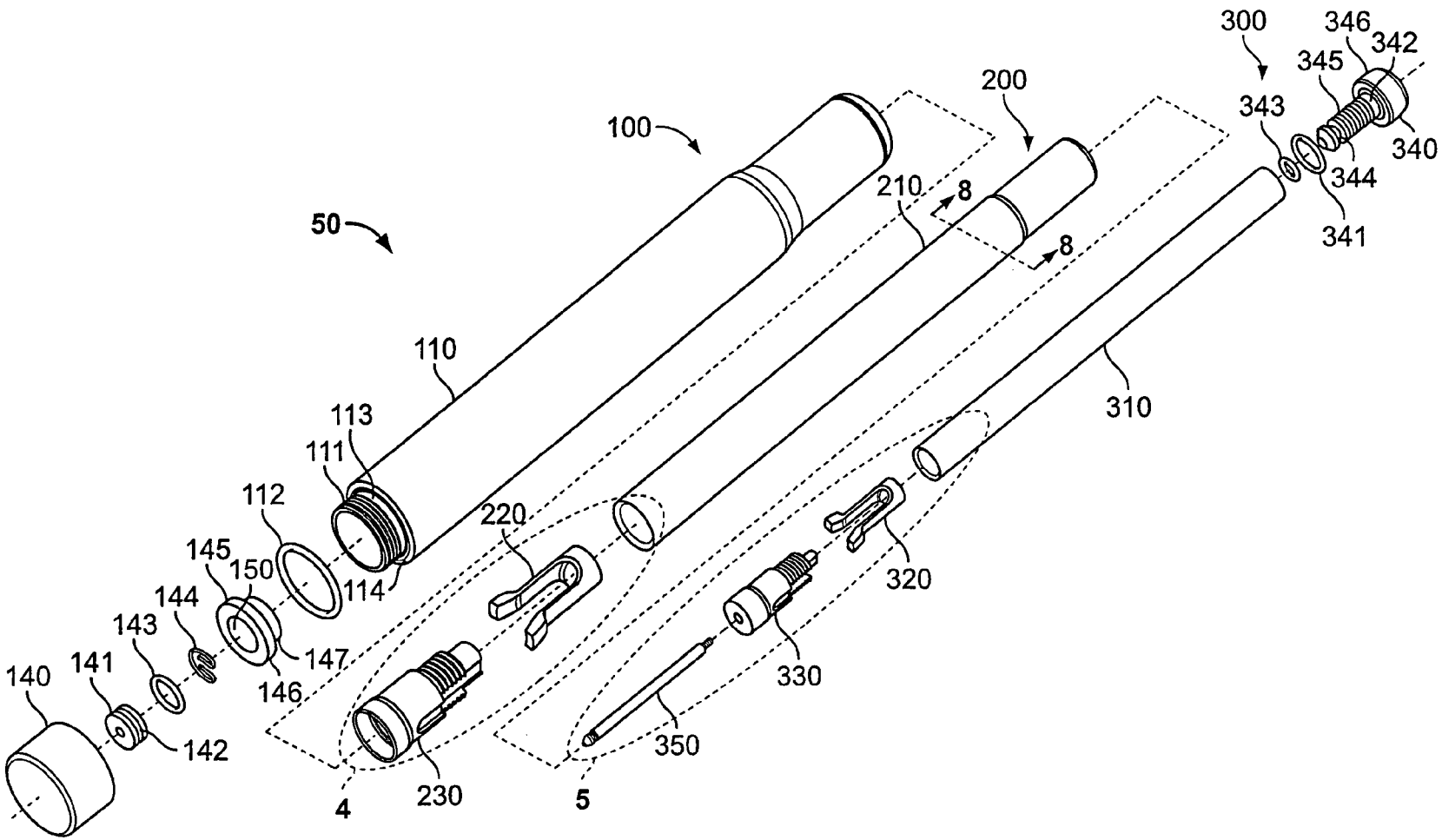
FIG. 3 is an exploded perspective view of that embodiment showing all of the parts.
Figure 4:
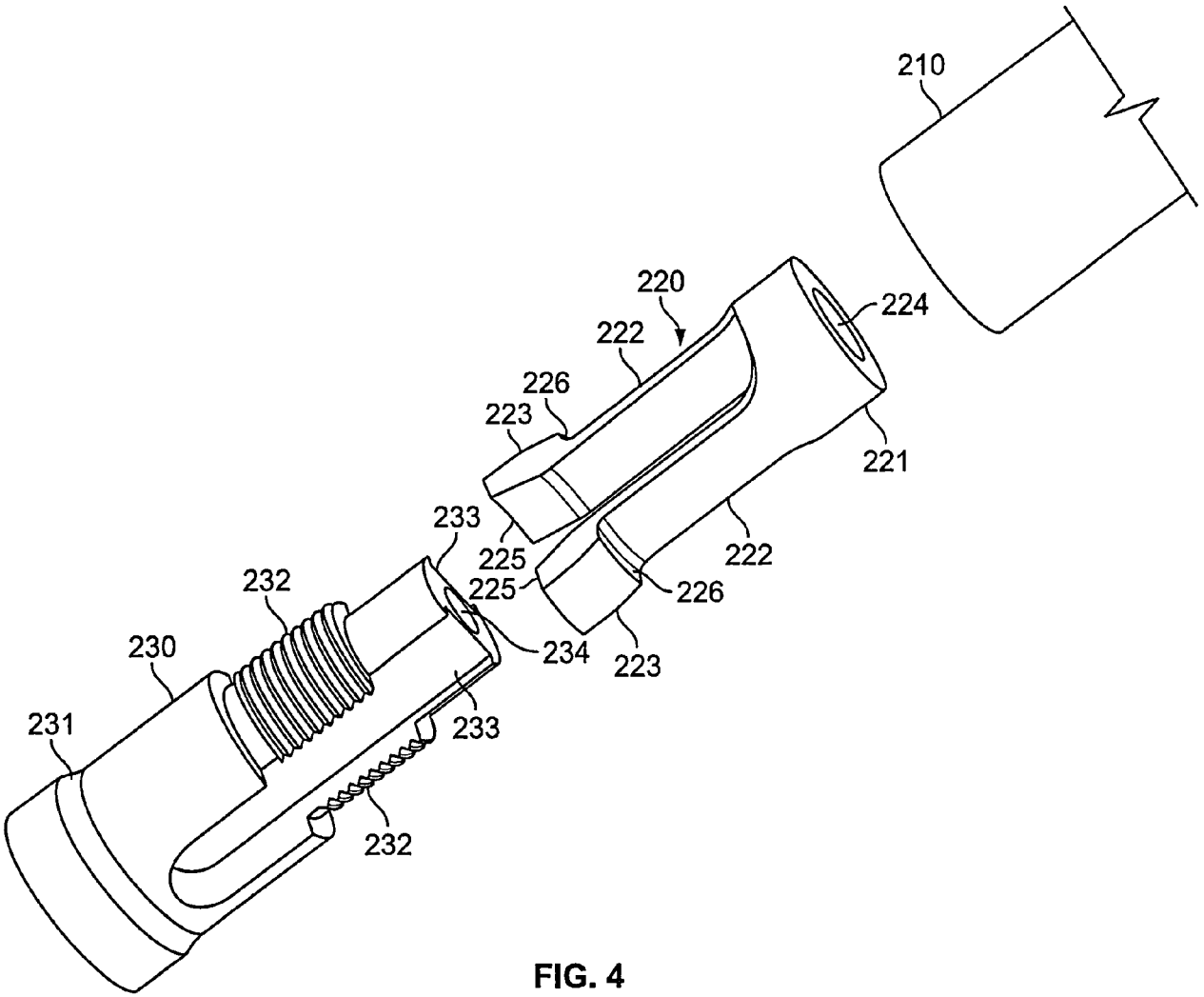
FIG. 4 is an exploded perspective view showing part of the second section of that embodiment.

FIG. 3 is an exploded perspective view showing all of the parts of the example of baton 50. In that example, section 200 comprises a tubular member 210, a locking member 220, and a stopping member 230. FIG. 4 is an exploded perspective view showing part of section 200. In that example, stopping member 230 comprises a stopping surface 231, two threaded areas 232, and two grooves 233 separating the threaded areas 232. It also comprises a bore 234 going through stopping member 230 along the longitudinal axis.

In the example of baton 50, locking member 220 comprises a second end portion 221, two shafts 222, and two locking lugs 223. It also comprises a bore 224 going through second end portion 221 along the longitudinal axis. Each of the locking lugs 223 is flexibly connected to second end portion 221 by a shaft 222. In the illustrated embodiment, each of locking lugs 223 comprises a lip 226, and the two lips 226 are generally equidistant from second end portion 221. In that embodiment, each of locking lugs 223 comprises a first end surface 225 that is generally transverse to the longitudinal axis, and the two first end surfaces 225 are different distances from second end portion 221. In the illustrated example, the first end surfaces 225 are slightly concave for added strength. In the illustrated example, the transition from each lip 226 to its respective shaft 222 is also curved rather than angular for added strength.

In the example of baton 50, locking member 220 is positioned over stopping member 230, with each locking lug 223/shaft 222 pair fitting into a respective groove 233. Stopping member 230 is screwed into a first end of tubular member 210, holding generally all of locking member 220 except locking lugs 223 inside tubular member 210. Lips 226 extend out far enough radially from the longitudinal axis to prevent the locking lugs 223 from fitting into tubular member 210. In the illustrated embodiment, locking member 220 is left free-floating. That is, it has a range of free movement allowing the locking lugs 223 to move in generally radial directions relative to the longitudinal axis.

b. Section 300—Retainer Post, and Stopping and Locking Members

In the example of baton 50, similar to section 200, section 300 comprises a tubular member 310, a locking member 320, a stopping member 330, a tip 340, and a retainer post 350.

Figure 5:
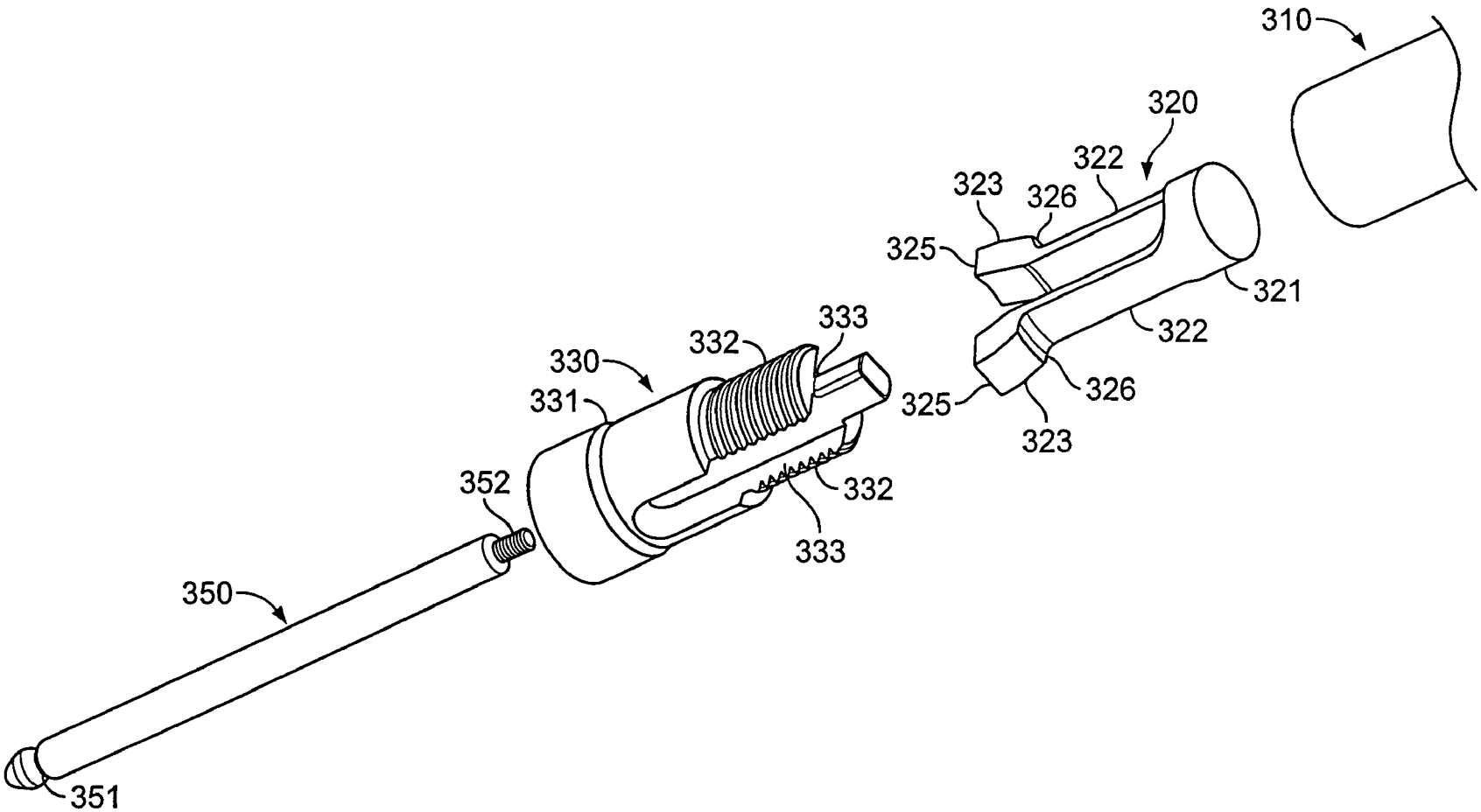
FIG. 5 is an exploded perspective view showing part of the third section of that embodiment.

FIG. 5 is an exploded perspective view showing part of section 300. In that example, stopping member 330 comprises a stopping surface 331, two threaded areas 332, and two grooves 333 separating the threaded areas 332.

In the example of baton 50, locking member 320 comprises a second end portion 321, two shafts 322, and two locking lugs 323. Each of the locking lugs 323 is flexibly connected to second end portion 321 by a shaft 322. In the illustrated embodiment, each of locking lugs 323 comprises a lip 326, and the two lips 326 are generally equidistant from second end portion 321. In that embodiment, each of locking lugs 323 comprises a first end surface 325 that is generally transverse to the longitudinal axis, and the two first end surfaces 325 are different distances from second end portion 321. In the illustrated example, the first end surfaces 325 are slightly concave for added strength. In the illustrated example, the transition from each lip 326 to its respective shaft 322 is also curved rather than angular for added strength.

In the example of baton 50, locking member 320 is positioned over stopping member 330, with each locking lug 323/shaft 322 pair fitting into a respective groove 333. Stopping member 330 is screwed into a first end of tubular member 310, holding generally all of locking member 320 except locking lugs 323 inside tubular member 310. Lips 326 extend out far enough radially from the longitudinal axis to prevent the locking lugs 323 from fitting into tubular member 310. In the illustrated embodiment, locking member 320 is left free-floating. That is, it has a range of free movement allowing the locking lugs 323 to move in generally radial directions relative to the longitudinal axis.

In the example of baton 50, retainer post 350 comprises a groove 351 at a first end of retainer post 350, and a threaded area 352 at a second end of retainer post 350. In the illustrated embodiment, retainer post 50 is screwed into a first end of stopping member 330.

c. Section 300—Tip

In the example of baton 50, tip 340 comprises a threaded area 345 that is screwed into a second end of tubular member 310. In this embodiment (best illustrated in FIG. 3), tip 340 also comprises O-rings 341 and 343 that are positioned adjacent threaded area 345 over annular areas 342 and 344, respectively. The use of two O-rings 341 and 343 is one example of a means for inhibiting inadvertent disengagement of tip 340 from tubular member 310.

In other embodiments, there may not be a separate tip component, there may be a different tip, or the tip may be secured differently (for example, it can snap on or be secured by other fasteners as are known in the art). An advantage of a tip that is easily removed (such as by unscrewing in the illustrated example) is that tip 340 is easily interchanged with other end portions. For example, tip 340 comprises a knob end 346 with a larger outer diameter than the diameter of the inner surface of the second end of tubular member 310 into which tip 340 is secured. However, tip 340 can be replaced by a tip with a cylindrical end. It can be replaced with a tip with an end whose outer diameter remained no larger than the diameter of the second end of tubular member 310 into which the tip is secured. (See e.g. U.S. application Ser. No. 11/234,665, incorporated herein by reference). Tip 340 also can be replaced by a tip with a magnet, or by a coupler for coupling an accessory.

d. Section 100

Figure 6:
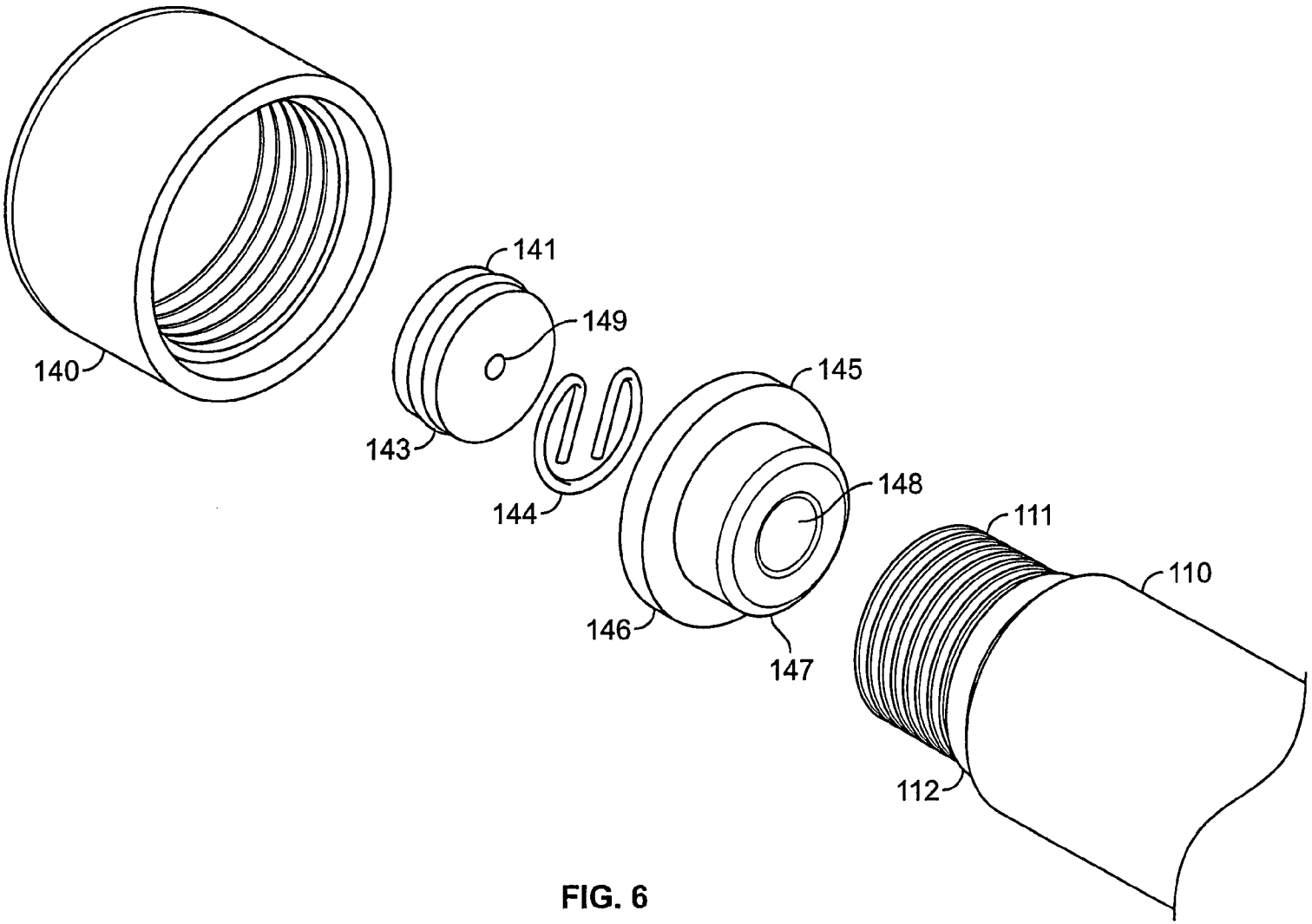
FIG. 6 is an exploded perspective view showing part of the first section of that embodiment.

In the example of baton 50, section 100 comprises a tubular member 110, a cap 140, a retainer clip 144, a clip disk 145, and a clip disk spacer 141. This is shown from two different perspectives in FIGS. 3 and 6. FIG. 6 is an exploded perspective view showing part of the first section of that embodiment. In the illustrated embodiment, a first end of tubular member 110 comprises a threaded area 111 onto which cap 140 is screwed. Tubular member 110 also comprises an o-ring 112 that is positioned adjacent threaded area 111 over annular area 113.

In the example of baton 50, clip disk 145 has a larger outer diameter at a first end 146 and a smaller outer diameter at a second end 147. Retainer clip 144 is positioned in a recess 150 in the first end 146 of clip disk 145, and is held in position against the second end 147 by clip disk spacer 141 that is also positioned in recess 150. Clip disk 145 also comprises a bore 148 going through second end 147 to recess 150 along the longitudinal axis. In its second end facing retainer clip 144, clip disk spacer 141 comprises a recess 149 around the longitudinal axis. Clip disk spacer 141 also comprises an annular groove 142 and an o-ring 143 that is positioned in groove 142. Clip disk 145 is positioned in cap 140.

In the example of baton 50, cap 140 is screwed onto tubular member 110, holding clip disk 145 at the first end of tubular member 110. Clip disk second end 147 has a smaller outer diameter and fits inside tubular member 110, but clip disk first end 146 has a larger outer diameter that prevents it from fitting into tubular member 110.

In the example of baton 50, tubular member 110 comprises a friction-grip outer covering 114 to facilitate use of outermost section 100 as a handle for baton 50. For example, the cover may be molded on to provide an integral, unitary handle grip which is permanently bonded as described in U.S. Pat. No. 5,645,276 or as described in U.S. Pat. No. 6,623,361. As is known in the art, embodiments may use no covering or a different covering, for example.

In other embodiments, there may not be a separate cap component, there may be a different cap, or the cap may be secured differently (for example, it can snap on or be secured by other fasteners as are known in the art). An advantage of a cap that is easily removed (such as by unscrewing in the illustrated example) is that cap 140 is easily interchanged with other end portions. For example, cap 140 can be replaced by a cap with a logo, a leverage cap with a groove for improving retention and control of baton 50, a swivel cap with a swivel appendage, a cap with a wrist strap, a flashlight, a cap with a retainer clip, a cap with a key ring; a spray dispensing device, a coupler for coupling with an accessory, or a coupler for coupling with a second baton. These examples are described in some of the patents identified in the background section above.

e. Retention in Retracted Position

Figure 7:
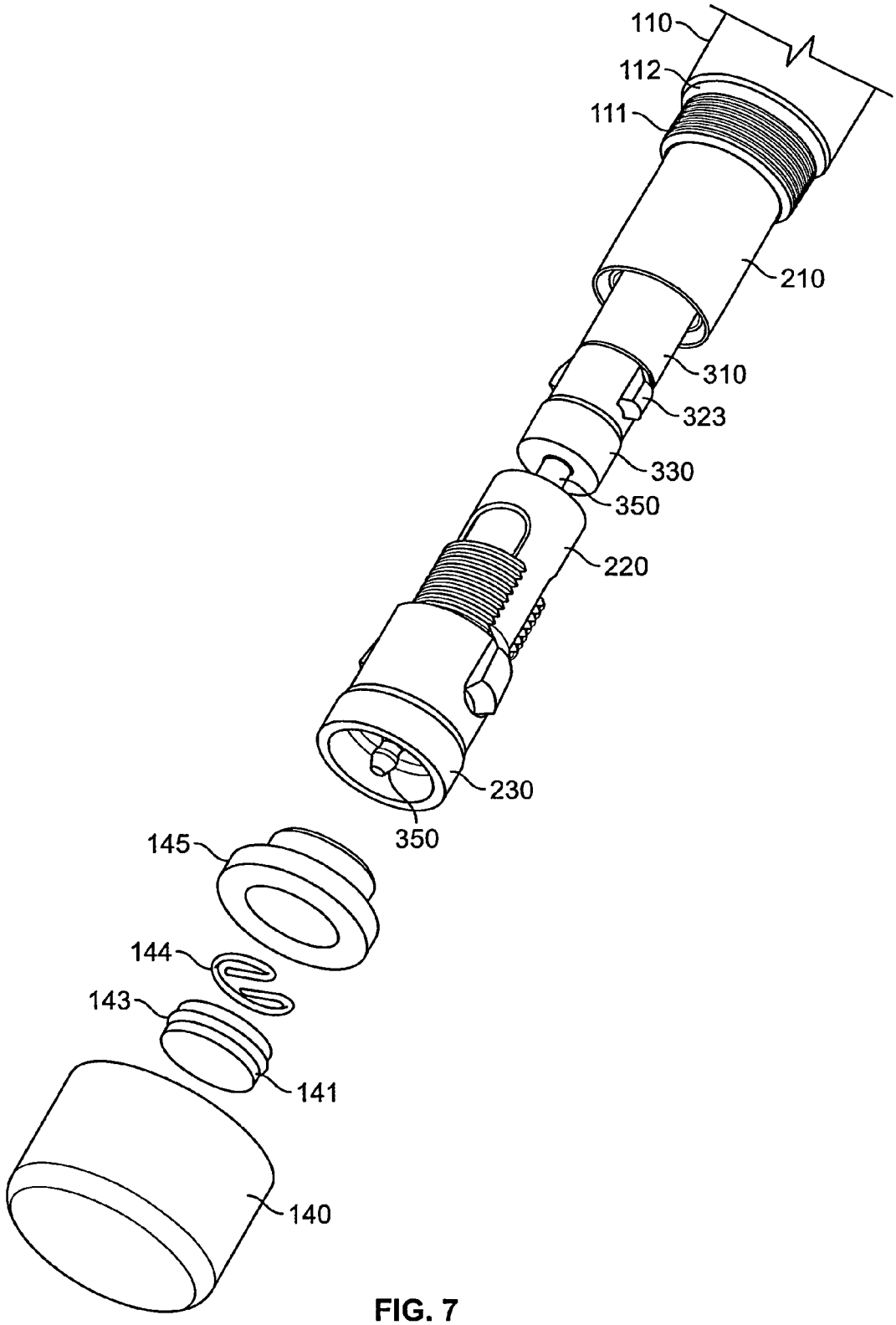
FIG. 7 is a partially exploded perspective view showing part of that embodiment when it is close to the retracted position.

In the retracted position of one embodiment (as shown in FIG. 2), sections 200 and 300 of baton 50 are retained inside section 100. Retention in the retracted position is illustrated in part by FIG. 7, that is a partially exploded perspective view showing part of baton 50 when it is close to the retracted position. As described above, a second end of retainer post 350 is secured to a first end of stopping member 330. In moving toward its retracted position, section 300 moves inside tubular member 210 along the longitudinal axis. As the first end of section 300 approaches the first end of section 200, the first end of retainer post 350 moves through bores 224 and 234 of locking member 220 and stopping member 230, respectively. Sections 200 and 300 continue to move inside tubular member 110 along the longitudinal axis. As sections 200 and 300 approach the first end of section 100, the first end of retainer post 350 moves through bore 148 of clip disk 145, through retainer clip 144, and into recess 149 of clip disk spacer 141.

In the example of baton 50, retainer clip 144 is sufficiently resilient to widen as the first end of retainer post 350 begins to pass through it, and to spring back and engage groove 351. This engagement retains retainer post 350, and consequently sections 200 and 300, in the retracted position until there is sufficient force along the longitudinal axis to disengage retainer post 350 from retainer clip 144. Typically, swinging up baton 50 can whip sections 200 and 300 out of the retracted position.

The described arrangement is one example of a means for inhibiting inadvertent extension of the inner baton sections relative to the outermost section. However, there can be many other arrangements to releasably retain the inner sections in the retracted position and to inhibit inadvertent extension. For example, various components can be shaped differently or arranged differently. For example, there can be different ways of holding a resilient member in the cap, a resilient member can be in tubular member 110 rather than in cap 140, a resilient member can be held to the innermost section instead of the outmost section, there can be a cam and tongue arrangement, there can be a release actuator, and so forth. Some alternatives are described in some of the patents identified in the background section above.

f. Stopping Extension and Locking in Extended Position

In some embodiments, extension of sections 200 and 300 along the longitudinal axis is limited by corresponding stopping surfaces. In the example of baton 50, annular stopping surface 331 on stopping member 330 can engage annular stopping surface 211 on the inside surface of tubular member 210 to limit the extension of section 300 relative to section 200. Similarly, annular stopping surface 231 on stopping member 230 can engage a stopping surface (not shown) on the inside surface of tubular member 110 to limit the extension of section 200 relative to section 100. In the illustrated embodiment, the stopping surfaces are tapered transitions from one diameter to another. For example, the stopping surfaces may be tapered at an angle of about 15° relative to the longitudinal axis. In other embodiments, other means for limiting the extension along the longitudinal axis of an inner section relative to a preceding section can be, for example, extended tapered portions, abrupt transverse transitions, discontinuous surfaces, protrusions of various shapes and sizes, combinations of recesses and spring-tensioned projections, and so forth.

Figure 8:
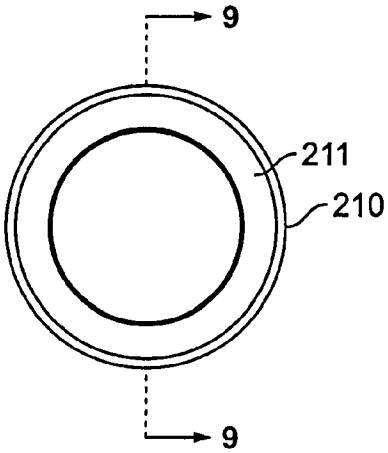
FIG. 8 is a cross-section view of a tubular member taken along line 8-8 of FIG. 3.
Figure 9:
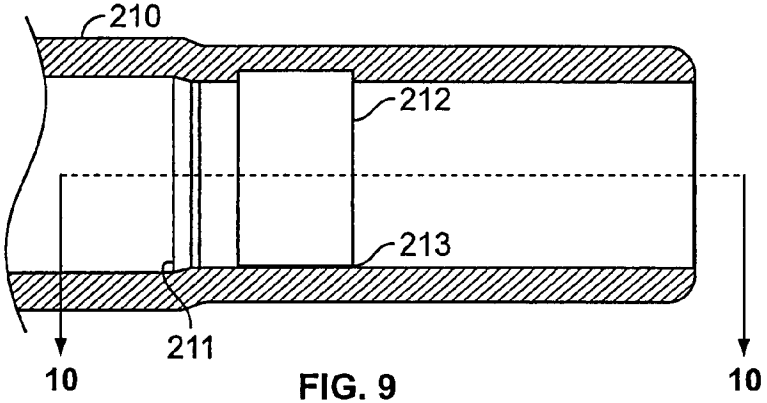
FIG. 9 is a partial cross-section view of the tubular member taken along line 9-9 of FIG. 8.
Figure 10:
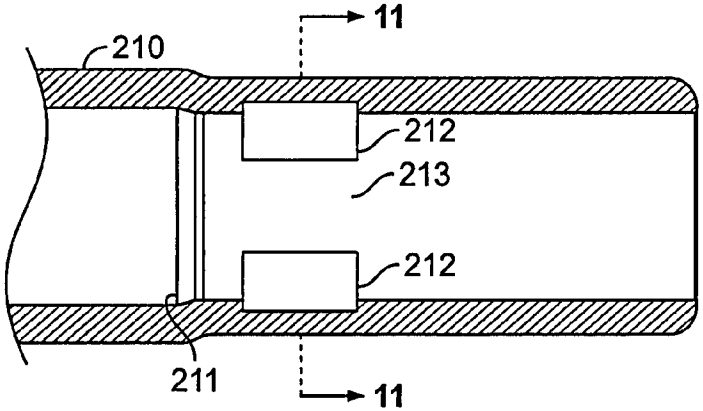
FIG. 10 is a partial cross-section view of the tubular member taken along line 10-10 of FIG. 9.
Figure 11:
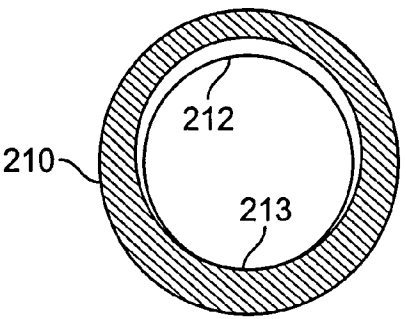
FIG. 11 is a cross-section view of the tubular member taken along line 11-11 of FIG. 10.

Annular stopping surface 211 and eccentric groove 212 on the inside surface of tubular member 210 are illustrated in FIGS. 8-11. FIG. 8 is a cross-section view of tubular member 210 taken along line 8-8 of FIG. 3, that is, a view along the longitudinal axis showing stopping surface 211. FIG. 9 is a partial cross-section view of tubular member 210 taken along line 9-9 of FIG. 8, that is, a view looking at one side of part of the inner surface of tubular member 210. It shows eccentric groove 212 in the inner surface of tubular member 210, just past stopping surface 211. Eccentric groove 212 extends radially outwardly by varying depths about the longitudinal axis, reducing to zero depth for at least a portion 213 of its circle about the longitudinal axis. FIG. 10 is a partial cross-section view of tubular member 210 taken along line 10-10 of FIG. 9, that is, similar to the view of FIG. 9 with the viewing perspective rotated by 90°. FIG. 11 is a cross-section view of tubular member 210 taken along line 11-11 of FIG. 10, that is, a view along the longitudinal axis showing eccentric groove 212.

In the example of baton 50, section 300 is locked in its extended position relative to section 200 when at least one locking lug 323 enters eccentric groove 212. Locking lugs 323 extend out far enough radially from the longitudinal axis to prevent them from fitting into tubular member 310. Consequently, they are available and extend out far enough radially to enter eccentric groove 212, that acts as a locking surface. A first end surface 325 of each locking lug 323 is generally transverse to the longitudinal axis. When any locking lug 323 is in eccentric groove 212, its first end surface 325 will inhibit movement of section 300 from its extended position toward its retracted position.

In the example of baton 50, locking lugs 323 have to pass stopping surface 211 before they can enter eccentric groove 212. This passage is possible because locking lugs 323 are flexibly connected to second end portion 321 by shafts 322, respectively. Therefore, they can be flexed inwardly to pass stopping surface 211, and can then spring outwardly. This is one example of a means for moving an inner section from its retracted position to its extended position relative to a preceding section. In other examples of such moving means, the arrangement, the dimensions, or the operation of locking means can obviate having to flex locking lugs past stopping means.

In the example of baton 50, locking member 320 is free-floating with a range of free movement allowing locking lugs 323 to move radially relative to the longitudinal axis. This facilitates quickly moving at least one locking lug 323 into eccentric groove 212 regardless of the angular orientation of section 300 relative to section 200 about the longitudinal axis. In addition, eccentric groove 212 and locking lugs 323 are dimensioned and positioned relative to each other and relative to stopping surfaces 211 and 331 to avoid rubbing or frictional drag between a first end surface 325 and a locking surface of eccentric groove 212. This is advantageous for quickly locking section 300 in its extended position. That is, when there is a very fast swinging motion to whip out the inner sections 200 and 300 of baton 50 to the extended position, there can be a reaction to the engagement of stopping surfaces 211 and 331 that tends to cause the inner sections 200 and 300 to bounce back from the extended position. Therefore, it is advantageous if one of locking lugs 323 can enter eccentric groove 212 very quickly.

g. Retraction from Extended Position

In the example of baton 50, eccentric groove 212 reduces to zero depth at portion 213 about the longitudinal axis, at which there is no locking surface to prevent passage of a locking lug 323. In the example of baton 50, there is more than one locking lug 323 so that at least one locking lug 323 will be positioned to enter eccentric groove 212 when section 300 moves to its extended position.

In the example of baton 50, the first end surfaces 325 of locking lugs 323 are different distances from second end portion 321. To retract section 300 from its extended position, section 300 can be rotated about the longitudinal axis relative to section 200 until the first end surface 325 that is farthest from second end portion 321 aligns with portion 213. At that angular orientation, there is no locking surface to prevent passage of that first end surface 325, and section 300 can be moved axially inward along the longitudinal axis relative to section 200. However, the other locking lug 323 will be in eccentric groove 212 to again inhibit retraction of section 300.

In the example of baton 50, section 300 can continue to be rotated until the first end surface 325 that is next farthest from second end portion 321 aligns with portion 213 to allow continued retraction of section 300. Before that continued rotation, section 300 already will have been moved axially inward enough so that the other locking lug 323 is no longer aligned with eccentric groove 212. During that continued rotation, that other locking lug 323 will be flexed radially inward instead of entering eccentric groove 212, and it will not prevent the continued retraction of section 300.

Locking section 300 in its extended position relative to section 200 and retraction of section 300 from its extended position have been illustrated and described. Locking section 200 in its extended position relative to section 100 and retraction of section 200 can, for example, be accomplished similarly. The illustrated and described embodiment is one example of a means for locking each inner section in its extended position relative to a preceding section, and for moving each inner section from its extended position to its retracted position by rotating that inner section relative to the preceding section about the longitudinal axis. In other examples of such means, there can, for example, be different numbers of locking lugs, there can be different dimensions and arrangements of the interacting components, and there can be different components for effecting the locking with twist release accomplished by the described embodiment. It is not necessary that every embodiment include every feature described.

From the foregoing, it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. An expandable baton comprising:

a plurality of telescoping tubular sections;

a second section of the plurality of sections moveable, along a longitudinal axis of the telescoping sections, between a retracted position and an extended position relative to a first section of the plurality of sections;

the second section nesting within the first section, when the second section is in the retracted position;

at least two locking lugs for releasably retaining the second section in the extended position;

first and second ones of the locking lugs each having a respective first end surface;

the respective first end surfaces of the first and second locking lugs being located at different distances along the longitudinal axis relative to each other;

the locking lugs positioned about the longitudinal axis so that a locking surface aligns with at least one of the locking lugs to inhibit movement of the second section from the extended position toward the retracted position, regardless of an angular orientation of the second section relative to the first section about the longitudinal axis;

the locking lugs positioned about the longitudinal axis so that for each one of the locking lugs there is at least one angular orientation, of the second section relative to the first section about the longitudinal axis, at which the locking surface and that one of the locking lugs can pass each other uninhibited, when the second section is moving from the extended position toward the retracted position;

wherein the second section can move from the extended position to the retracted position by progressively rotating the second section, relative to the first section about the longitudinal axis, until each of the locking lugs passes the locking surface uninhibited.

2. The expandable baton of claim 1, further comprising corresponding stopping surfaces for limiting the extension along the longitudinal axis of the second section relative to the first section.

3. The expandable baton of claim 1, further comprising:

a stopping surface;

wherein each of the locking lugs can be flexed past the stopping surface when the second section is moving from the retracted position toward the extended position.

4. The expandable baton of claim 1, further comprising:

a stopping surface;

each one of the locking lugs being shaped and positioned to facilitate flexing that one of the locking lugs past the stopping surface when the second section is moving from the retracted position toward the extended position.

5. The expandable baton of claim 1, further comprising:

a locking member;

the locking member comprising a second end portion;

the locking member further comprising each of the locking lugs;

each of the locking lugs being flexibly and integrally connected with the second end portion;

the respective first end surfaces of the first and second locking lugs being located at different distances from the locking member second end portion.

6. The expandable baton of claim 5, each of the first end surfaces being concave.

7. The expandable baton of claim 1, the second section comprising a locking member;

the locking member comprising each of the locking lugs.

8. The expandable baton of claim 7, the locking member being individually replaceable.

9. The expandable baton of claim 7, the locking member further comprising:

a second end portion;

a plurality of shafts respectively connecting the locking lugs to the second end portion;

each of the locking lugs having a lip;

a transition from each lip to its respective shaft being curved.

10. The expandable baton of claim 1, the second section comprising:

a tubular member;

a locking member;

a stopping member;

the stopping member secured to a first end of the tubular member;

the locking member positioned between the stopping member and the tubular member;

the locking member comprising each of the locking lugs.

11. The expandable baton of claim 10, the locking member further, comprising:

a second end portion;

a plurality of shafts respectively connecting the locking lugs to the second end portion;

generally all of the locking member except the locking lugs being positioned inside the first end of the tubular member;

each shaft and respective locking lug being positioned in a respective groove of the stopping member.

12. The expandable baton of claim 11, the stopping member threadingly secured to an inner surface of the first end of the tubular member;

at least one of the locking lugs having a lip;

a radial distance of the lip from the longitudinal axis being greater than a radial distance of the inner surface from the longitudinal axis.

13. The expandable baton of claim 10, the locking member having a range of free movement allowing the locking lugs to move in generally radial directions relative to the longitudinal axis.

14. The expandable baton of claim 10, the stopping member comprising a stopping surface for limiting the extension along the longitudinal axis of the second section relative to the first section.

15. The expandable baton of claim 14, the first section comprising a tubular member;

an inner surface of the tubular member of the first section comprising a first section stopping surface;

the first section stopping surface and the stopping member stopping surface being structured and dimensioned to engage each other for limiting the extension along the longitudinal axis of the second section relative to the first section.

16. The expandable baton of claim 1, the first section comprising a tubular member;

an inner surface of the tubular member comprising a first section stopping surface;

the second section comprising a stopping member;

the stopping member comprising a stopping member stopping surface;

the first section stopping surface and the stopping member stopping surface being structured and dimensioned to engage each other for limiting extension along the longitudinal axis of the second section relative to the first section.

17. The expandable baton of claim 16, the stopping member being individually replaceable.

18. The expandable baton of claim 16, each of the stopping surfaces being tapered at an angle of about 15° relative to the longitudinal axis.

19. The expandable baton of claim 1, the first section comprising a tubular member;

an inner surface of the tubular member comprising the locking surface.

20. The expandable baton of claim 19, the locking surface forming an eccentric groove extending radially outwardly by varying depths around a circle about the longitudinal axis;

the eccentric groove depth reducing to zero for a least a portion of the circle;

wherein, when the second section is moving from the extended position toward the retracted position, each one of the locking lugs can pass the locking surface uninhibited when that one of the locking lugs aligns with the portion of the circle.

21. The expandable baton of claim 20, further comprising:

corresponding stopping surfaces for limiting the extension along the longitudinal axis of the second section relative to the first section;

the first end surfaces of the first and second locking lugs being generally transverse to the longitudinal axis;

the first and second locking lugs being positioned to allow at least one of the first and second locking lugs to move into the eccentric groove as soon as the stopping surfaces limit the extension of the second section, without rubbing between the locking surface and the first end surface of the at least one locking lug.

22. The expandable baton of claim 20, the second section comprising a tubular member;

the second section comprising a locking member;

the second section comprising a stopping member;

the inner surface of the tubular member of the first section comprising a first section stopping surface;

the stopping member comprising a stopping member stopping surface;

the first section stopping surface and the stopping member stopping surface being structured and dimensioned to engage each other for limiting extension along the longitudinal axis of the second section relative to the first section;

the locking member comprising each of the locking lugs;

the locking member comprising a second end portion;

the locking member comprising a plurality of shafts respectively connecting the locking lugs to the second end portion;

each shaft and respective locking lug being positioned in a respective groove of the stopping member;

the stopping member threadingly secured to an inner surface of a first end of the the tubular member of the second section;

generally all of the locking member except the locking lugs being positioned inside the first end of the tubular member of the second section;

the locking member having a range of free movement allowing at least one of the locking lugs to move into the eccentric groove as soon as the stopping surfaces limit the extension of the second section.

23. The expandable baton of claim 20, a longitudinal length of the eccentric groove exceeding a longitudinal length of each of the locking lugs.

24. The expandable baton of claim 1, further comprising:

a third section of the plurality of sections moveable along the longitudinal axis between a retracted position and an extended position relative to the second section;

the third section nesting within the second section, when the third section is in the third section retracted position;

at least two locking lugs for releasably retaining the third section in the third section extended position;

first and second ones of the locking lugs for retaining the third section each having a respective first end surface;

the respective first end surfaces of the first and second locking lugs for retaining the third section being located at different distances along the longitudinal axis relative to each other;

the locking lugs for retaining the third section positioned about the longitudinal axis so that a locking surface for retaining the third section aligns with at least one of the locking lugs for retaining the third section to inhibit movement of the third section from the third section extended position toward the third section retracted position, regardless of an angular orientation of the third section relative to the second section about the longitudinal axis;

the locking lugs for retaining the third section positioned about the longitudinal axis so that for each one of the locking lugs for retaining the third section there is at least one angular orientation, of the third section relative to the second section about the longitudinal axis, at which the locking surface for retaining the third section and that one of the locking lugs for retaining the third section can pass each other uninhibited, when the third section is moving from the third section extended position toward the third section retracted position;

wherein the third section can move from the third section extended position to the third section retracted position by progressively rotating the third section, relative to the second section about the longitudinal axis, until each of the locking lugs for retaining the third section clears the locking surface for retaining the third section.

25. The expandable baton of claim 1, further comprising:

a tip;

the tip removably secured to an end of one of the plurality of sections.

26. The expandable baton of claim 25, the tip comprising:

a threaded portion for securing the tip to the one of the sections;

at least two o-rings;

each of the o-rings positioned adjacent the threaded portion for inhibiting inadvertent disengagement of the tip from the one of the sections.

27. The expandable baton of claim 1, an innermost section of the plurality of telescoping sections comprising a tubular member;

an end of the tubular member structured and dimensioned for removable attachment of an end portion selected from a group consisting of: a tip, a threaded tip, a tip with a knob end of larger outer diameter than a diameter of an inner surface of the end of the tubular member, a tip with a cylindrical end, a tip with a smaller outer diameter than the inner surface diameter, a tip with a magnet, and a coupler for coupling with an accessory.

28. The expandable baton of claim 1, further comprising:

a retainer post;

a retainer clip;

the retainer clip positioned at a first end of the first section;

the retainer post comprising a groove at a first end of the retainer post;

a second end of the retainer post secured to one of the plurality of sections;

the retainer clip structured and dimensioned to engage the groove for inhibiting inadvertent outward extension of the one of the sections along the longitudinal axis from a retracted position relative to the first section.

29. The expandable baton of claim 28, the first section further comprising:

a tubular member;

a cap;

a clip disk;

the retainer clip positioned within the cap;

the clip disk positioned within the cap so as to hold the retainer clip within the cap;

the cap threadingly secured to a first end of the tubular member;

an outer diameter of the clip disk exceeding a diameter of an inner surface of the first end of the tubular member.

30. The expandable baton of claim 1, further comprising:

a retainer clip;

an innermost section of the plurality of telescoping sections;

the innermost section comprising a tubular member;

the innermost section comprising a tip;

the innermost section comprising stopping member;

the innermost section comprising a retainer post;

the stopping member threadingly secured to the tubular member at a first end of the innermost section;

the tip threadingly secured to the tubular member at a second end of the innermsot section;

the retainer post comprising a groove at a first end of the retainer post;

a second end of the retainer post threadingly secured to the stopping member;

the retainer clip positioned at a first end of the first section;

the retainer clip structured and dimensioned to engage the groove for inhibiting inadvertent outward extension of the innermost section along the longitudinal axis from a retracted position relative to the first section.

31. The expandable baton of claim 1, the first section comprising:

a tubular member;

the tubular member comprising a friction-grip outer covering.

32. The expandable baton of claim 1, the first section comprising:

a tubular member;

a first end of the tubular member structured and dimensioned for removable attachment to a closing portion selected from a group consisting of: a cap, a threaded cap, a cap with a logo, a leverage cap with a groove for improving retention and control of the baton, a swivel cap with a swivel appendage, a cap with a wrist strap, a flashlight, a cap with a retainer clip, a cap with a key ring; a spray dispensing device, a coupler for coupling with an accessory, and a coupler for coupling with a second baton.

33. An expandable baton for use as an intermediate force weapon, the baton comprising:

a series of telescoping tubular sections, including an outermost section and at least one inner section;

the outermost section comprising a friction-grip outer covering;

each of the at least one inner sections moveable, along a longitudinal axis of the telescoping sections, between a retracted position and an extended position relative to a preceding one of the series of sections;

each of the at least one inner sections nesting within the preceding one of the series of sections, when that one of the inner sections is in its retracted position;

means for locking each of the at least one inner sections in its extended position relative to the preceding one of the series of sections, and for moving each one of the least one inner sections from its extended position to its retracted position by rotating that one of the inner sections relative to the preceding section about the longitudinal axis.

34. The expandable baton of claim 33, further comprising means for limiting the extension along the longitudinal axis of each of the at least one inner sections relative to preceding section.

35. The expandable baton of claim 33, further comprising means for moving each of the at least one inner sections from its retracted position to its extended position relative to the preceding section.

36. The expandable baton of claim 33, further comprising:

a tip removably secured to an innermost one of the series of sections;

means for inhibiting inadvertent disengagement of the tip from the innermost section.

37. The expandable baton of claim 33, further comprising means for inhibiting inadvertent extension of the any of the at least one inner sections along the longitudinal axis from a retracted position relative to the outermost section.

38. The expandable baton of claim 33, the outermost section comprising:

a tubular member;

the tubular member comprising the outer covering;

a first end of the tubular member structured and dimensioned for removable attachment to a closing portion selected from a group consisting of: a cap, a threaded cap, a cap with a logo, a leverage cap with a groove for improving retention and control of the baton, a swivel cap with a swivel appendage, a cap with a wrist strap, a flashlight, a cap with a retainer clip, a cap with a key ring; a spray dispensing device, a coupler for coupling with an accessory, and a coupler for coupling with a second baton.

39. An expandable baton comprising:

a plurality of telescoping tubular sections;

a second section of the plurality of sections moveable, along a longitudinal axis of the telescoping sections, between a retracted position and an extended position relative to a first section of the plurality of sections;

the second section nesting within the first section, when the second section is in the retracted position;

the first section comprising a tubular member;

an inner surface of the tubular member comprising an eccentric groove extending radially outwardly by varying depths around a circle about the longitudinal axis;

the eccentric groove depth reducing to zero for a least a portion of the circle;

the eccentric groove comprising a locking surface to inhibit movement of the second section from the extended position toward the retracted position.

40. The expandable baton of claim 39, the second section comprising at least two locking lugs;

each of the locking lugs being structured and dimensioned for releasable engagement with the locking surface.

41. The expandable baton of claim 40, wherein, when the second section is moving from the extended position toward the retracted position, each one of the locking lugs can pass the locking surface uninhibited when that one of the locking lugs aligns with the portion of the circle.

42. The expandable baton of claim 41, first and second ones of the locking lugs each having a respective first end surface;

the respective first end surfaces of the first and second locking lugs being located at different distances along the longitudinal axis relative to each other;

the locking lugs positioned about the longitudinal axis so that the locking surface aligns with at least one of the locking lugs, regardless of an angular orientation of the second section relative to the first section about the longitudinal axis;

wherein the second section can move from the extended position to the retracted position by progressively rotating the second section, relative to the first section about the longitudinal axis, until each of the locking lugs aligns with the portion of the circle and passes the locking surface uninhibited.

43. An expandable baton comprising:

a plurality of telescoping tubular sections comprising an outermost section and at least one inner section;

each of the at least one inner sections moveable, along a longitudinal axis of the telescoping sections, between a retracted position and an extended position relative to a preceding one of the plurality of sections;

each one of the at least one inner sections nesting within the preceding section, when said one of the at least one inner sections is in the retracted position;

the at least one inner section comprising an innermost section;

the innermost section comprising a retainer post aligned in a direction of the longitudinal axis;

the retainer post comprising a groove;

the outmost section comprising a retainer clip;

the retainer clip positioned generally transverse to the longitudinal axis;

the retainer clip structured and dimensioned to engage the groove for inhibiting inadvertent outward extension of the innermost section along the longitudinal axis from a retracted position relative to the outermost section.

44. The expandable baton of claim 43, the innermost section further comprising:

a tubular member;

a tip;

a stopping member;

the stopping member threadingly secured to the tubular member at a first end of the innermost section;

the tip threadingly secured to the tubular member at a second end of the innermsot section;

the groove located at a first end of the retainer post;

a second end of the retainer post threadingly secured to the stopping member.

45. The expandable baton of claim 43, the outermost section further comprising:

a tubular member;

a cap;

a clip disk;

the retainer clip positioned within the cap;

the clip disk positioned within the cap so as to hold the retainer clip within the cap;

the cap threadingly secured to a first end of the tubular member;

an outer diameter of the clip disk exceeding a diameter of an inner surface of the first end of the tubular member.

* * * * *